United States Patent [19]

Bjurling

[11] Patent Number: 4,630,855

[45] Date of Patent: Dec. 23, 1986

[54] LIFTING YOKE FOR CONTAINERS

[75] Inventor: Anders Bjurling, Skultuna, Sweden

[73] Assignee: Dynatrans Technology Ltd., Douglas, Sweden

[21] Appl. No.: 778,434

[22] Filed: Sep. 20, 1985

[51] Int. Cl.[4] ..... B66C 1/00

[52] U.S. Cl. ..... 294/81.21; 294/81.1

[58] Field of Search ..... 294/67.33, 81.1–81.5, 294/81.53, 81.54, 81.6, 119.1; 52/118, 731; 212/266, 267, 269

[56] References Cited

U.S. PATENT DOCUMENTS

| | | | |
|---|---|---|---|
| 3,076,673 | 2/1963 | Kaplan et al. | 294/119.1 X |
| 3,495,370 | 2/1970 | Habro et al. | 52/118 X |
| 3,762,754 | 10/1973 | Goyarts | 294/81.5 X |
| 3,874,719 | 4/1975 | Goyarts | 294/81.21 X |

FOREIGN PATENT DOCUMENTS

| | | | |
|---|---|---|---|
| 2207821 | 8/1973 | Fed. Rep. of Germany | 294/81.21 |
| 2207041 | 6/1974 | France . | |
| WO81/03323 | 11/1981 | PCT Int'l Appl. | 294/81.21 |

*Primary Examiner*—Cherry, Johnny D.
*Attorney, Agent, or Firm*—Laurence R. Brown

[57] ABSTRACT

A lifting yoke for containers consists of a central beam (1) and two coaxial extending beams (2, 3) guided for reciprocating movements by the central beam and capable of telescoping one into the other. A guide tube (4) arranged coaxially inside the extending beams is able to connect them together when they are extended one from the other and to guide one of the beams into the other when they are telescoped one into the other. The telescoping mechanism (5) for the lifting yoke consists of a hydraulic cylinder (9) with driving wheels (10), two pulleys (11, 12), a cable (13) running over the driving wheels and the pulleys, and protruding rods (14, 15) attached to the cable for operating the extending beams (2, 3).

4 Claims, 9 Drawing Figures

3
7
8
15
12
18
16
10
6
1
17
13
6
5
9
11
18
2
14
7
8
III
III

II
7
15
3
18
12
6
13
10
17
4
5
9
6
16
4'
18
1
11
2
14
7
II 2
7
8

LIFTING YOKE FOR CONTAINERS

TECHNICAL FIELD

The present invention relates to a lifting yoke for containers, consisting of a central beam and two extending beams, which are coaxial with the central beam and guided therein for reciprocating movements and are equipped with means for gripping containers, one of said extending beams being capable of telescoping into the other.

DESCRIPTION OF THE PRIOR ART

Standard containers are 20, 30 or 40 feet in length, although other lengths may occur exceptionally. They are all identical in width and have a standardized engagement system for gripping and lifting the container by means of a lifting yoke on a container handling machine, such as a lifting crane, a container truck, a gantry crane or similar devices.

Fixed lifting yokes exist in many different forms. They are of simple design, low weight and robust construction, but suffer from the inherent disadvantage that the lifting yoke must be changed when the container size is changed.

In order to be able to lift containers of different sizes with one and the same lifting yoke, it is necessary instead to use a telescopic yoke which, in accordance with the prior art, may be either of two main types: three-section and five-section.

In the three-section type, two simple extending beams are arranged in parallel alongside each other inside a central housing. The advantages associated with this are the small number of moving parts, the moderate weight and the comparatively low height, whereas the disadvantages are the relatively great width (providing an obstructed view from above), the restricted space for the so-called telescoping mechanism, and the torsional stress applied to the beams due to the nature of the design.

In the five-section type, on the other hand, the extending beams are arranged axially in line with each other and are built up of quite short, telescoping sections. The advantages of this type are that no torsional moment produced by the design is applied to the extending beams, and that the yoke itself is narrow and only moderately obtrusive, also from above, whilst the disadvantages are that the design contains a relatively large number of parts, giving it a high weight, and that it requires high-quality guides and minimal clearances.

Variations of the indicated main types are also encountered.

A telescoping mechanism, i.e. a machine or mechanism which controls the position of the extending beams or, in other words, adjusts the lifting yoke to suit different container lengths, need not be particularly powerful, since the lifting yoke is not subject to load during adjustment. However, the yoke is frequently moved around whilst adjustment is taking place and is exposed to jolts and shocks, for which reason the mechanism must be robust and durable. It should also have a low servicing requirement.

Three main types of telescoping mechanism are encountered most commonly: these are mechanisms with two hydraulic cylinders, with four hydraulic cylinders, and with a chain, protruding rods and motor.

A telescoping mechanism with two hydraulic cylinders is best suited to a three-section yoke, with each cylinder actuating a single extending beam. The mechanism is of simple construction, has few moving parts and a low servicing requirement, and is reliable in operation.

Because of their great stroke (as much as 3 m), the cylinders are extremely prone to bending irrespective of the nature of their mounting. The resulting increase in their dimensions leads to increases in both cost and weight.

Guides to restrict bending may be arranged on the outside of the cylinders as an alternative, although these naturally make the design more complicated.

The telescoping mechanism with four hydraulic cylinders, in which each cylinder actuates its own section of the appropriate extending arm, is best suited to five-section lifting yokes. The stroke of the cylinder is limited in this case (to perhaps 1.5 m), as a consequence of which there is a reduced proneness in bending. The functional reliability is high, and the servicing requirement is low.

However, the increased number of cylinders results in a higher price, a less reliable system, and a more complicated control arrangement.

In the telescoping mechanism of the final main type, an endless chain driven by a motor runs over two chain sprockets inside the housing of the yoke, in conjunction with which each of the two extending beams is connected to its own section of the chain by means of protruding rods. Synchronous extension and withdrawal is achieved in this way, and the protruding rods are easily made resistant to bending.

The disadvantages are the greater servicing requirement and sensitivity of the motor and the higher cost than a single cylinder. Also, the chain requires lubrication and inspection and exhibits relatively low elasticity.

The principal functional requirements imposed on a container lifting yoke are low weight, operating reliability, impact resistance and low servicing requirement.

Often the low weight of the lifting yoke will mean that a smaller and less expensive container handling machine can be used, resulting in a major reduction in handling costs. Since the lifting yoke is raised and lowered unceasingly, and since the question of energy recovery during lowering does not arise, low weight equates to a considerable saving in energy.

The operating reliability is extremely important, since down-time is costly and the risk of accident must be minimized.

The driver of any container handling machine is faced by problems of visibility, and the yoke will require to be re-positioned between lifting operations. It is unavoidable that the yoke will be exposed to heavy shocks, and accordingly it must exhibit great impact-resistance.

The lifting yoke is often likely to be used in places where servicing is difficult and even dangerous to perform. Down-time to permit the yoke to be serviced will often also involve down-time for a container handling machine, which is many times more expensive. Alternatively, high servicing requirements may call for a number of yokes to be used with a single machine.

THE INVENTION

A lifting yoke—of the kind referred to by way of introduction—offering more advantages than any previously disclosed yoke can be achieved in accordance with the invention if a guiding tube coaxial with the extending beams, but with a smaller cross-sectional area than the extending beam having the smallest cross-sectional area, is arranged to connect the two extending beams in the position in which they are extended away from each other and, when they are telescoped one into the other, to guide one beam into the other.

In order to avoid the high transverse forces which arise in beams of ordinary, rectangular cross-section and which require thicker beam walls to be provided, the beams in accordance with the invention have a hexagonal cross-section, with resulting transfer of transverse forces into the central section of the beam concerned.

In order to avoid the various disadvantages which, in accordance with the foregoing, are associated with previously disclosed telescoping mechanisms, this mechanism for the new lifting yoke in accordance with the invention consists of a hydraulic cylinder mounted on the central beam, coaxial driving wheels rotatably arranged at the end of the piston rod, two pulleys rotatably mounted at either side thereof on the central beam, a cable so arranged as to pass from an attachment point on the central beam, around one of the driving wheels, one of the pulleys, the other pulley, the other driving wheel, and to an attachment point on the central beam, in such a way that a certain movement of the driving wheels will produce twice as much movement in the cable, and a protruding rod attached to each of the sections of the cable which exhibits said double movement in its own direction of travel, the other end of said rod being attached to a transverse beam at the end of each extending beam.

Each of the protruding rods is conveniently controlled between a pulley and a guide roller. The two driving wheels are arranged in a yoke controlled by a control guide mounted o a central beam.

BRIEF DESCRIPTION OF THE DRAWINGS

The invention is described below in more detail with reference to the accompanying drawings, in which.

DESCRIPTION OF A PREFERRED EMBODIMENT

Figure 2:
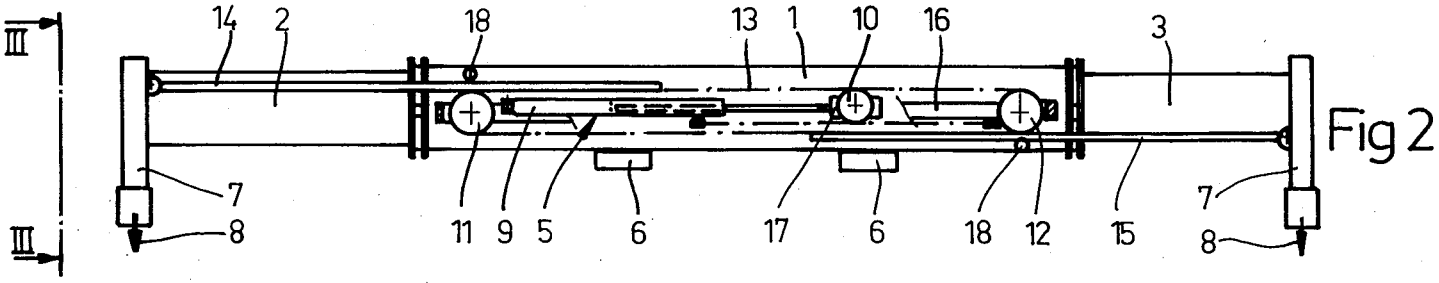
FIG. 2 is a side view of the lifting yoke (along the line II—II in FIG. 1)

A lifting yoke in accordance with the invention contains the following principal parts: a central beam 1, two extending beams 2, 3, an inner guide tube 4, and a telescoping mechanism, generally identified by 5.

The central beam 1 can be provided with lifting eyes (not shown), and/or welded attachments 6 for, for example, a fork of a fork-lift truck.

Each of the extending beams 2, 3 is provided at its end with a transverse beam 7 which, at its lower edge, has two conventional container engagement keys 8 at a standardized distance from one another so as to be able to take hold of containers at their respective points of engagement.

The central beam 1 encloses and guides the two extending beams 2 and 3 in their telescoping movements in order to adjust the holding width of the lifting yoke to suit the container to be lifted. The extending beam 2 to the left in FIG. 1 is also capable of enclosing and guiding the right-hand extending beam 3.

Figure 6:
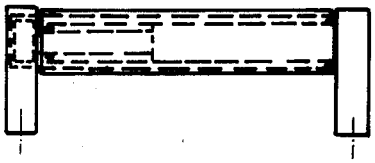

When lifting the smallest standard containers with a length of 20 feet, the left-hand extending beam 2 is fully inserted into the central beam 1, and the right-hand extending beam 3 is fully inserted into the left-hand extending beam 2 (and into the central beam 1) to the position shown in FIG. 6.

Figure 4:
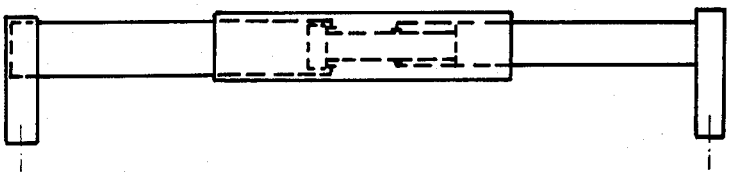
FIGS. 4, 5 and 6 are diagrammatic side views on a smaller scale illustrating the positions of the main parts of the lifting yoke at various positions of extension.

When the two extending beams 2 and 3 are moved outwards for the purpose of lifting the largest standard containers with a length of 40 feet, these two beams will, as shown in FIG. 4, move apart from one another inside the central beam 1.

Figure 1:
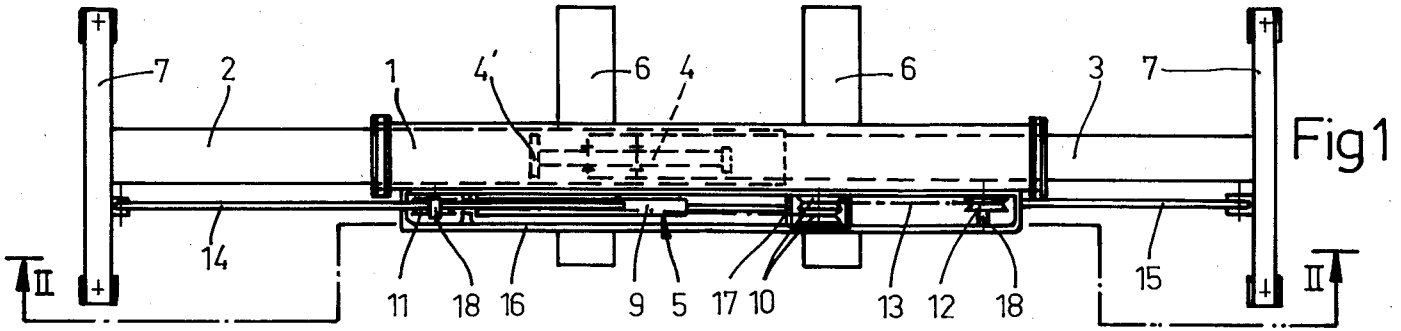
FIG. 1 is a top view of a lifting yoke in accordance with the invention.
Figure 5:
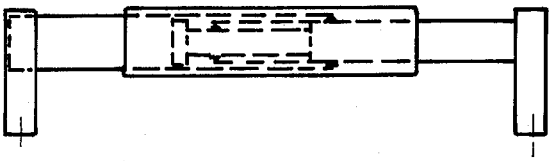

The guide tube 4 is intended, when the extending beams are telescoped one into the other for the purpose of lifting a small container—as for example illustrated in FIG. 5—to guide the more slender extending beam 3 to the right in FIG. 1 into the larger, left-hand extending beam 2, and also to ensure in the course of other operating phases that the central beam 1 guides the extending beams to the smallest possible degree.

The guide tube 4 is thus preferably guided by two guides in the more slender extending beam 3, and exhibits at its end inside the larger extending beam 2 a flange 4' corresponding to the internal shape of that beam.

The four-section lifting beam with this design thus offers the following advantages: no torsional moment produced by the design is applied to the extending beams, the yoke itself is narrow and only moderately obtrusive (including from above), its weight is low, the number of moving parts is small, and the height is reasonable. The four-section yoke in this way exhibits practically all the advantages of the previously disclosed yokes, but without suffering from their disadvantages.

Previously disclosed yokes have extending beams of rectangular cross-section which, at the correct width-to-height ratio, provides excellent rigidity, but on the other hand extremely high transverse forces, especially at the intersection on leaving the central beam, said transverse forces even being capable of causing the bodies to buckle. In order to counteract this, the extending beams are often provided with internal reinforcements.

Figure 3:
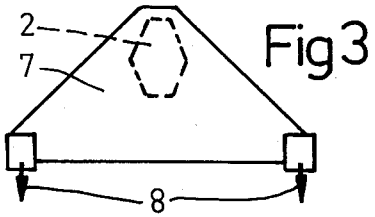
FIG. 3 is an end view (the line III—III in FIG. 2) of the lifting yoke.

The presence of such internal reinforcements would, in the design in accordance with the invention, prevent the extending beams from being telescoped one into the other. The problem is solved by both the central beam and the extending beams having hexagonal cross-section—see the broken line in FIG. 3. It is easy to demonstrate that the transverse forces in this way are transferred into the central section of the beam, and that transverse forces about 8 times stronger are required in order to produce buckling in a beam of hexagonal cross-section than in a beam of rectangular cross-section. As a consequence of this the hexagonal beams can be constructed from thinner sheet metal, resulting in a saving and yet at the same time providing an adequate safety margin against collapse.

A telescoping mechanism 5 for the lifting yoke in accordance with the invention consists of the following main parts: a hydraulic cylinder 9, two driving wheels 10, two pulleys 11, 12, a cable 13, and two protruding rods 14, 15.

The end of the hydraulic cylinder 9 to the left in FIGS. 1 and 2 is attached in an articulated fashion to the central beam 1 or rather to a control guide 16 attached to it. At the end of the piston rod of the hydraulic cylinder 9 two coaxial driving wheels 10 are rotatably arranged in a yoke 17 controlled for reciprocating movements by the control guide 16. The two pulleys 11 and 12 are similarly rotatably arranged in the control guide.

A steel cable or steel wire 13 is so arranged, starting from a point of attachment on the control guide adjacent to the pulley 12 to the right in FIGS. 1 and 2, as to pass over one of the driving wheels 10, back round the pulley 12, to the pulley 11, the second driving wheel 10, and finally to a point of attachment on the control guide on the hydraulic cylinder 9. Attached to the upper section of the cable between the left-hand pulley 11 and the second driving wheel 10 is one end of one of the protruding rods 14, the other end of which is attached in an articulated fashion to the left-hand transverse beam 7. Attached to the lower section of the cable between the two pulleys 11 and 12 is one end of the second protruding rod 15, the other end of which is attached in an articulated fashion to the right-hand transverse beam 7.

The two protruding rods 14, 15 are guided for reciprocating movements between the pulleys 11, 12 and guide rollers 18 rotatably arranged adjacent to them.

It is obvious that the design of the telescoping mechanism illustrated and described here produces a stepping-up of a certain movement in the piston rod of the hydraulic cylinder 9, giving twice as much movement in the two protruding rods 14, 15.

Figure 7:
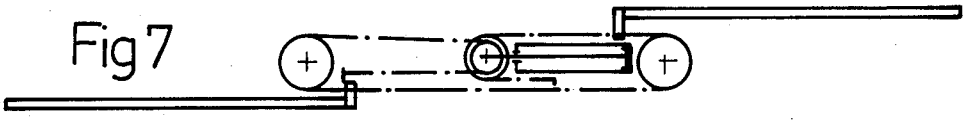
FIGS. 7, 8 and 9 illustrate the telescoping mechanism of the lifting yoke at various corresponding extended positions.
Figure 8:
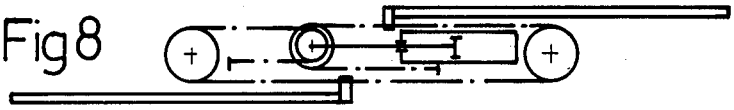
Figure 9:
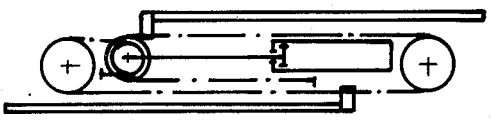

The telescoping mechanism is shown in FIGS. 7–9, from which all reference numerals have been omitted for the sake of clarity, in three operating positions corresponding to the positions of the lifting yoke shown in FIGS. 4–6.

The telescoping mechanism illustrated and described here offers distinct advantages in relation to previously disclosed mechanisms: a hydraulic cylinder with a relatively short stroke drives the mechanism; cables, unlike chains, are able to operate without lubrication; braided steel cables exhibit considerable elasticity; the protruding rods move in an entirely synchronous fashion (facilitating the control and adjustment of the mechanism); the servicing requirement is minimal, and the protruding rods are easily made resistant to bending.

Modifications are, of course, possible within the scope of the following claims.

I claim:

1. A lifting yoke for containers consisting of a central beam (1) and two extending beams (2, 3), which are coaxial with the central beam and guided therein for reciprocating movements and are equipped with means (7, 8) for gripping containers, one of said extending beams (3) being so arranged as to be capable of telescoping into the other (2), characterized in that a guide tube (4) coaxial with the extending beams (2, 3) and having a smaller cross-sectional area than the extending beam (3) with the smallest cross-sectional area thereby to produce a light yoke weight is arranged to connect the two extending beams in the position in which they are extended away from each other and, when they are telescoped one into the other, to guide one beam (3) into the other (2), and in that the central beam (1) and the extending beams have light weight telescoping reinforcing and load distributing means to increase the yoke capacity to bear transverse forces comprising beams of hexagonal cross-section with resulting transfer of transverse forces in the central section of the beam.

2. A lifting yoke for containers consisting of a central beam (1) and two extending beams (2, 3), which are coaxial with the central beam and guided therein for reciprocating movements and are equipped with means (7, 8) for gripping containers, one of said extending beams (3) being so arranged as to be capable of telescoping into the other (2), characterized in that a guide tube (4) coaxial with the extending beams (2, 3) and having a smaller cross-sectional area than the extending beam (3) with the smallest cross-sectional area is arranged to connect the two extending beams in the position in which they are extended away from each other and, when they are telescoped one into the other, to guide one beam (3) into the other (2), and in that the central beam (1) and the extending beams have hexagonal cross-sections with resulting transfer of transverse forces in the central section of the beam, further characterized by a telescoping mechanism (5) for the actuation of the reciprocating movements of the two extending beams (2, 3) consisting of a hydraulic cylinder (9) having a piston rod mounted on the central beam (1), coaxial driving wheels (10) rotatably arranged on the end of the piston rod, two pulleys (11, 12) rotatably arranged on the central beam at either side of the cylinder, a cable (13) arranged to pass from an attachment point on the central beam, around one of the driving wheels, one of the pulleys (11), the other pulley (12), the other driving wheel and to an attachment point on the central beam, in such a way that a certain movement of the driving wheels will produce twice as much movement in the cable, and a protruding rod (14, 15) attached to each of the sections of the cable which exhibits said double movement in its own direction of travel, the other end of said rod being attached to a transverse beam (7) at the end of each extending beam (2, 3).

3. A lifting yoke according to claim 2, characterized in that each of the protruding rods (14, 15) is guided between a pulley (11, 12) and a guide roller (18).

4. A lifting yoke according to claim 2, characterized in that the two driving wheels (10) are arranged in a yoke (17) controlled by a control guide (16) mounted on the central beam (1).

* * * * *